US008393936B2

(12) United States Patent
Wang

(10) Patent No.: US 8,393,936 B2
(45) Date of Patent: Mar. 12, 2013

(54) SUBSTRATE RETAINING RING FOR CMP

(75) Inventor: Yu Piao Wang, Jubei (TW)

(73) Assignee: IV Technologies Co., Ltd., Taichung (TW)

( * ) Notice: Subject to any disclaimer, the term of this patent is extended or adjusted under 35 U.S.C. 154(b) by 581 days.

(21) Appl. No.: 12/546,198

(22) Filed: Aug. 24, 2009

(65) Prior Publication Data

US 2010/0003898 A1 Jan. 7, 2010

Related U.S. Application Data

(63) Continuation of application No. 11/546,350, filed on Oct. 12, 2006, now Pat. No. 7,597,609.

(51) Int. Cl.
*B24B 7/22* (2006.01)

(52) U.S. Cl. ..... 451/288; 451/398; 451/442

(58) Field of Classification Search ..... 451/287, 451/288, 289, 398, 388, 442, 41
See application file for complete search history.

(56) References Cited

U.S. PATENT DOCUMENTS

| | | | |
|---|---|---|---|
| 1,398,020 | A | 11/1921 | Holley |
| 5,664,988 | A | 9/1997 | Stroupe et al. |
| 5,795,215 | A | 8/1998 | Guthrie et al. |
| 5,944,590 | A | 8/1999 | Isobe et al. |
| 6,116,992 | A | 9/2000 | Prince |
| 6,143,127 | A | 11/2000 | Perlov et al. |
| 6,146,260 | A | 11/2000 | Yi |
| 6,179,694 | B1 | 1/2001 | Quek |
| 6,224,472 | B1 | 5/2001 | Lai et al. |
| 6,231,428 | B1 | 5/2001 | Maloney et al. |
| 6,251,215 | B1 | 6/2001 | Zuniga et al. |
| 6,267,655 | B1 | 7/2001 | Weldon et al. |
| 6,309,290 | B1 | 10/2001 | Wang et al. |
| 6,447,380 | B1 | 9/2002 | Pham et al. |
| 6,602,116 | B1 | 8/2003 | Prince |
| 6,821,192 | B1 | 11/2004 | Donohue |
| 6,893,327 | B2 | 5/2005 | Kajiwara et al. |
| 6,916,226 | B2 | 7/2005 | Moloney et al. |
| 7,029,375 | B2 | 4/2006 | Phang et al. |
| 2003/0168169 | A1 | 9/2003 | Ishikawa et al. |

FOREIGN PATENT DOCUMENTS

| | | | |
|---|---|---|---|
| JP | 2000-288923 | A | 10/2000 |
| TW | 483061 | B | 4/2002 |

OTHER PUBLICATIONS

Chinese Office Action for Application No. 200710153654.8 dated Nov. 10, 2011, pp. 1-12.
Taiwanese Office Action for corresponding TW Application No. 096125625, dated Oct. 28, 2010, pp. 1-35, Taiwan.

*Primary Examiner* — Robert Rose
(74) *Attorney, Agent, or Firm* — Ditthavong Mori & Steiner, P.C.

(57) ABSTRACT

The edge effect or variation in polishing edge profile on a substrate undergoing CMP is reduced by structuring a retaining ring, housed in a carrier head for retaining the substrate, such that the polishing edge profile shifts back and forth with respect to the center of the substrate. Embodiments include structuring the retaining ring such that the width between inner and outer surfaces varies by an amount sufficient to compensate for polishing edge profile variation. Embodiments also include structuring the retaining ring such that the distance from the outer surface to the geometric inner surface varies. Embodiments further include structuring the retaining ring such that the distance between the outer surface to the perimeter of the substrate retained by the inner surface of the retaining ring varies.

20 Claims, 7 Drawing Sheets

SUBSTRATE RETAINING RING FOR CMP

RELATED PATENT APPLICATIONS

This is a continuation of U.S. patent application Ser. No. 11/546,350, filed Oct. 12, 2006.

FIELD OF THE INVENTION

The present invention relates to retaining rings for retaining a substrate during chemical mechanical polishing (CMP). The present invention is particularly applicable to retaining rings for use in CMP to obtain substrates with improved uniform planarity.

BACKGROUND ART

As the dimensions of semiconductor device features continue to shrink into the deep submicron range, it becomes increasingly more difficult to form the features with high dimensional accuracy. The minimum size of a feature depends upon the chemical and optical limits of a particular lithography system, notably the depth of focus of a particular tool. Therefore, it is of utmost importance to provide an extremely flat wafer or substrate surface during fabrication of integrated circuits as well as other electronic devices.

Conventional practices include planarizing a substrate surface to remove high topography by CMP, which typically involves introducing a chemical slurry during polishing to facilitate higher removal rates and selectivity between films on the substrate surface. Typically, CMP involves holding a substrate against a polishing pad under controlled pressure and rotational speed of the pad in the presence of the slurry or other fluid medium. The substrate is typically mounted in a carrier head and accommodated within a retaining device encircling the substrate to avoid slippage. The substrate is typically configured in the shape of a ring and generally characterized as a retaining ring. A bottom view of a conventional retaining ring is schematically illustrated in FIG. 1 and comprises an inner annular surface 10 and an outer annular surface 11. A substrate is typically accommodated within and retained by inner annular surface 10.

A problem attendant upon conventional CMP is known as the "edge effect", which is the tendency of the edge of the substrate to be polished at a rate different from the polishing rate at the center of the substrate. Thus, the edge effect typically results in either removing too much material from the substrate at the perimeter (overpolishing) and/or failing to remove sufficient material from the outer perimeter of the substrate (underpolishing) vis-à-vis the remainder of the substrate, resulting in an uneven edge polishing profile, thereby adversely impacting yield and/or reliability of devices fabricated on the substrate.

Accordingly, a need exists for retaining rings which eliminate or substantially reduce the edge effect encountered during conventional CMP. There exists a particular need for retaining rings which eliminate or substantially reduce the edge effect during CMP, can be utilized with a variety of substrates, and can be produced in a cost effective and efficient manner.

DISCLOSURE OF THE INVENTION

An advantage of the present invention is a retaining ring structured to eliminate or substantially reduce the edge effect or irregular edge polishing profile of a substrate undergoing CMP.

Another advantage of the present invention is a method of planarizing a substrate by CMP without or with a reduced edge effect or uneven edge polishing profile.

According to the present invention, the foregoing and other advantages are achieved in part by a retaining ring for accommodating a substrate during chemical mechanical polishing (CMP), the retaining ring having an outer surface and an inner surface such that a width from the inner surface to the outer surface in a radial direction varies in an amount sufficient to substantially reduce an edge effect by causing an edge polishing profile to shift back and forth toward the center of the substrate as the width varies during CMP.

Another advantage of the present invention is a retaining ring having an outer surface with a geometric center and an inner surface with a geometric center, wherein the geometric centers of the inner and outer surfaces are offset.

A further advantage of the present invention is a retaining ring having an inner surface, accommodating a substrate about its periphery, and an outer surface, wherein the distance between the outer surface to the perimeter of the substrate varies in a radial direction.

A further advantage of the present invention is a retaining ring having an inner surface with a geometric center and an outer surface, wherein a distance from the outer surface to the geometric center of the inner surface varies in a radial direction.

Another advantage of the present invention is a retaining ring comprising: an outer surface; and an inner surface, wherein a width from the inner surface to the outer surface varies in a radial direction; and the width at any point is constant across the entire thickness of the retaining ring.

A further advantage of the present invention is a retaining ring comprising: an inner surface having an annular shape; and an outer surface having a non-annular shape, wherein the width from the inner surface to the outer surface varies in a radial direction.

Another advantage of the present invention is a retaining ring comprising: an inner annular surface having a varying radius; and an outer surface, wherein a width from the inner surface to the outer surface varies in a radial direction.

Another advantage of the present invention is a method of planarizing a substrate by chemical mechanical polishing (CMP), the method comprising planarizing the substrate while retained in a polishing head including a retaining ring in accordance with embodiments of the present invention.

Embodiments of the present invention include structuring a retaining ring such that the width between the outer surface and the inner surface varies in a radial direction from about 2% to about 50% with respect to an average width, e.g., about 5% to about 30%. Embodiments of the present invention further include retaining rings wherein the inner surface has an annular shape, which may or may not have a substantially constant radius, and the outer surface may also have an annular shape. Embodiments of the present invention also include structuring the retaining ring such that the width between the outer surface and the inner surface is constant at any point across the entire thickness of the retaining ring.

Embodiments of the present invention further include structuring the retaining ring with an inner surface having an annular or non-annular shape, and an outer surface having an non-annular or annular shape, respectively. Embodiments of the present invention further include forming the retaining ring with an inner surface having a varying radius, as by having an annular inner surface with at least one recession and/or at least one projection, and an outer surface which may be annular or has a varying radius, as by having at least one recession and/or at least one projection.

Embodiments of the present invention also include retaining rings having a composite structure comprising upper and lower layers, and retaining rings comprising slurry distributing paths. Typically, the upper layer is harder than a lower layer, and the lowermost layer is structured to reduce the edge effect.

Additional advantages of the present invention will become readily apparent to those skilled in the art from the following detailed description, wherein embodiments of the present invention are described, simply by way of illustration of the best mode contemplated for carrying out the present invention. As will be realized, the present invention is capable of other and different embodiments and its several details are capable of modifications in various obvious respects, all without departing from the present invention. Accordingly, the drawings and description are to be regarded as illustrative in nature, and not as restrictive.

DESCRIPTION OF THE INVENTION

The present invention addresses and solves problems attendant upon conventional retaining rings employed to retain a substrate in a retaining head during CMP. The use of conventional retaining rings results in what is known as the edge effect manifested by a difference in the polishing rate profile between the edge of a substrate undergoing CMP and a remainder of the substrate resulting in irregular edge planarity leading to decreased yield. Although previous attempts have been made to address the edge effect, such efforts have not been sufficient to adequately fulfill the increasing requirements for precise submicron device technology.

Figure 1:
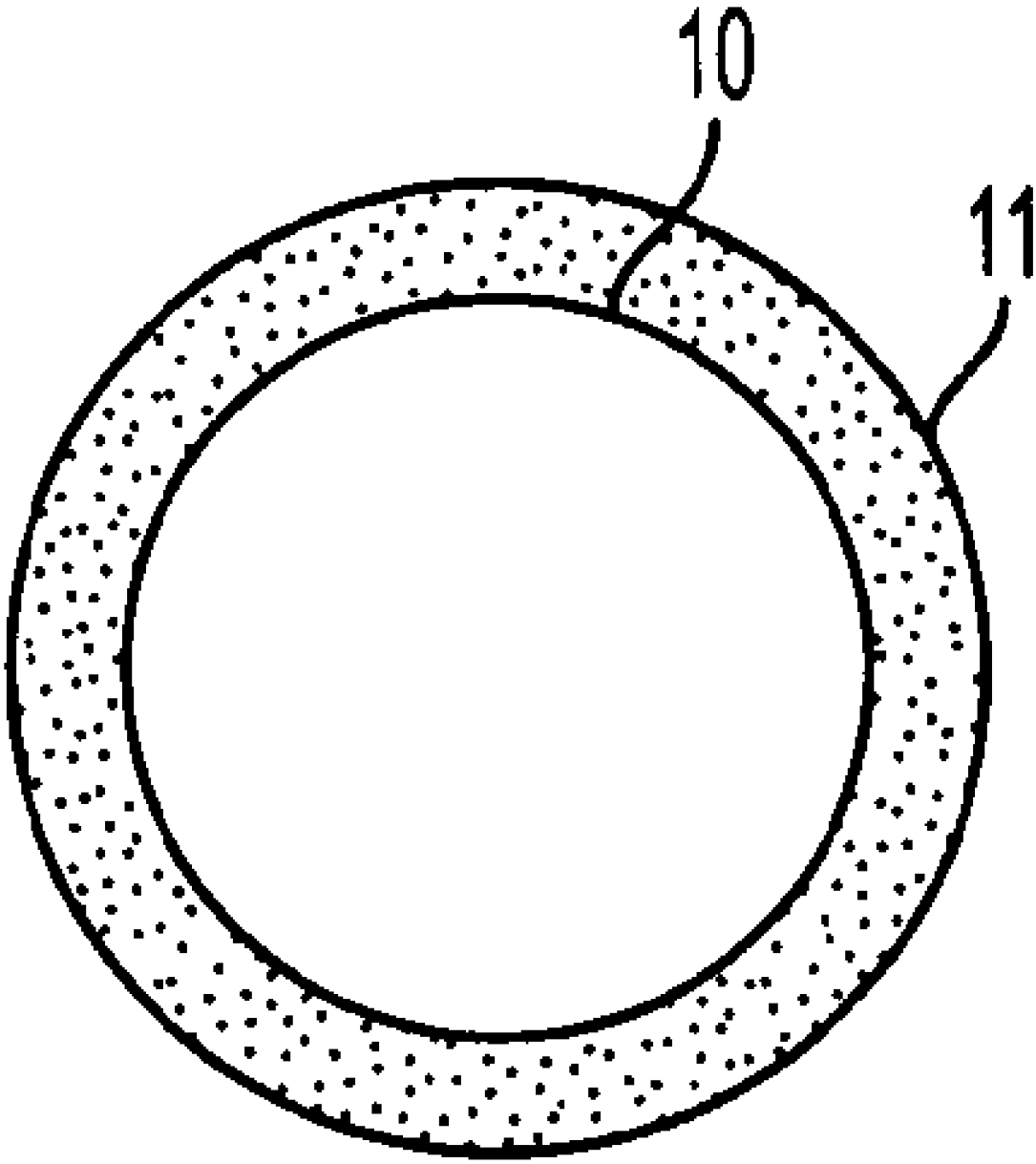
FIG. 1 PRIOR ART
FIG. 1 is a bottom view schematically illustrating a conventional retaining ring.
Figure 2A:
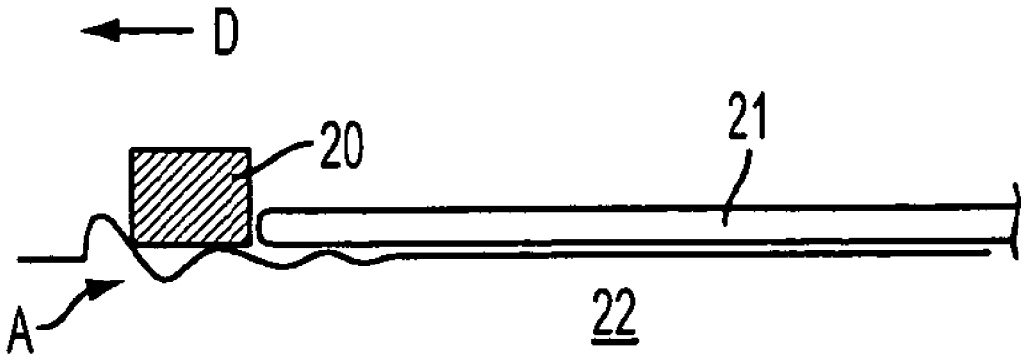
FIG. 2A schematically illustrates a cause of the edge effect problem.
Figure 2B:
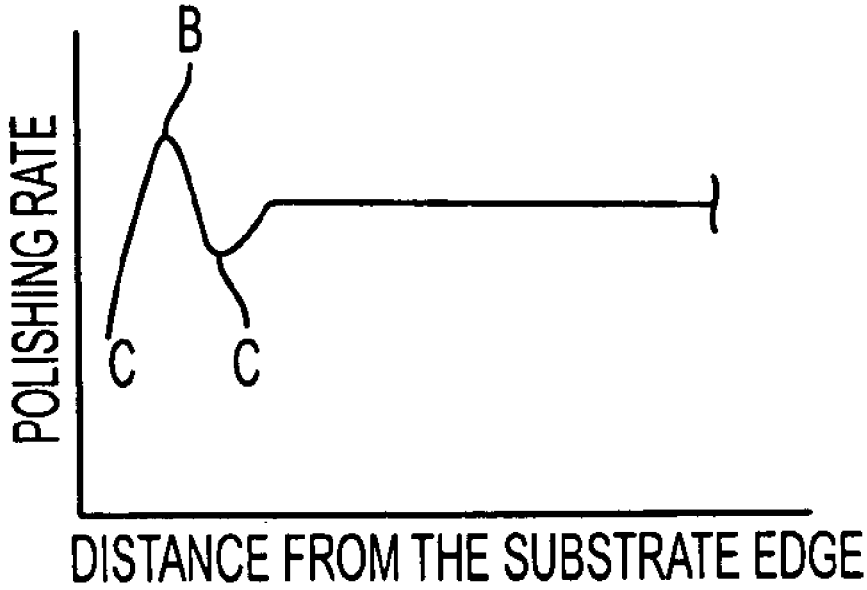
FIG. 2B is a graph illustrating the variation in polishing rate profile attendant upon applying conventional retaining rings.

Adverting to FIG. 2, it was found that the edge profile problem stems from the pressure exerted by a conventional retaining ring 20, accommodating substrate 21, against polishing pad 22 during CMP, resulting in surface deformation A at the edge of polishing pad 22. Reference character D denotes the direction of movement with respect to polishing pad 22. It was found that such polishing pad deformation is in the form of a wave which propagates from the outmost perimeter of the retaining device toward the substrate edge, and typically extends from about 5 to about 25 mm from the substrate edge for a wafer having a diameter of 200 mm or 300 mm. The edge effect stemming from the wave formed by retaining ring 20 bearing against substrate 22 generates an irregular or non-uniform polishing edge profile, illustrated in FIG. 2B, which is uneven across the substrate surface and has a large undesirable variation near the substrate edge, which includes regions having a higher removal rate B and/or lower removal rate C. The resulting uneven edge polishing profile decreases the yield and reliability of devices fabricated on the substrate.

The present invention addresses and solves the variation in edge polishing profile by strategically structuring the retaining ring to address the source of the edge effect by compensating for the edge polishing profile, as by shifting the edge polishing profile back and forth toward the center of the substrate to eliminate or substantially reduce the edge polishing effect. The expressions "substantially reduce", "substantially reducing", or "substantial reduction", when referred to the edge polishing profile is intended to encompass a reduction in the adverse edge effect or edge polishing profile in an amount sufficient to noticeably compensate for the variation in polishing edge profile which would ordinarily occur and sufficient to yield a substrate after CMP which is suitable for continued semiconductor device fabrication with high yield and high reliability.

Embodiments of the present invention include strategically structuring the retaining ring such that it has an outer surface and an inner surface wherein for retaining the substrate during CMP. The inner surface of the retaining ring is provided with a geometric center having a diameter greater than that of the substrate. The distance from the outer surface to the geometric center of the inner surface is made to vary in a radial direction.

In another embodiment, the distance from the outer surface to the perimeter of a substrate retained within the inner surface is made to vary in the radial direction. In accordance with another embodiment, the width from the inner surface to the outer surface is varied in the radial direction by an amount sufficient to compensate for the edge polishing effect. For example, the width between the inner surface and the outer surface in a radial direction is made to vary by an amount sufficient to shift the edge polishing profile back and forth toward the center of the substrate as the width varies during CMP, as by about 2% to about 50% with respect to an average width, e.g., about 5% to about 30% with respect to the average width.

Figure 3A:
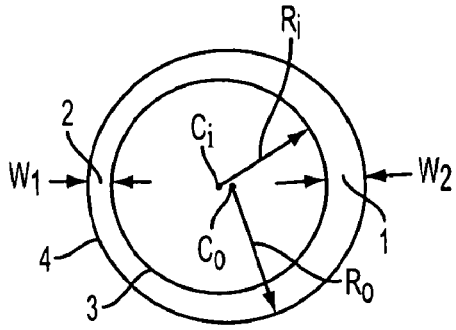
FIGS. 3A through 3G are bottom views schematically illustrating retaining rings in accordance with embodiments of the present invention.

A retaining ring having a width variation between the inner and outer surfaces in a radial direction can be obtained in accordance with various embodiments of the invention by strategically manipulating the shape and/or positioning of the inner and outer surfaces. For example, an embodiment of the present invention is schematically illustrated in FIG. 3A and comprises an annular inner surface 3 having a geometric center at $C_i$ and a radius $R_i$, and an outer annular surface 4 having a geometric center at $C_o$, which is offset from $C_i$, and a radius $R_o$. The width between the inner and outer surface $W_1$ at location 1 is smaller than the width between the inner and outer surface $W_2$ at location 2.

Figure 3B:
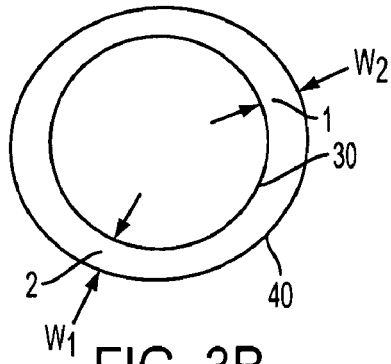

Another retaining ring in accordance with an embodiment of the present invention is schematically illustrated in FIG. 3B and has an annular inner surface 30 and an elliptical outer surface 40. As a result of varying the geometric shape of the inner and outer surfaces, the width between the inner and outer surfaces 30 and 40 varies in a radial direction. For example, at location 1 the width $W_1$ is smaller than the width $W_2$ at location 2.

Figure 3C:
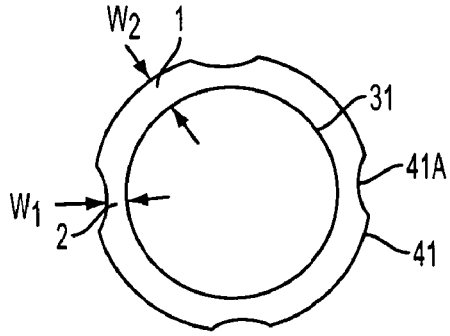

Another retaining ring in accordance with an embodiment of the present invention is schematically illustrated in FIG. 3C and comprises an annular inner surface 31 and an annular outer surface 41 having at least one recession, as at 41A. As a result of this variation between the shapes of the inner and outer surfaces of the retaining ring, the width varies in a radial direction. For example, the width $W_1$ at location 1 is smaller than the width $W_2$ at location 2.

Figure 3D:
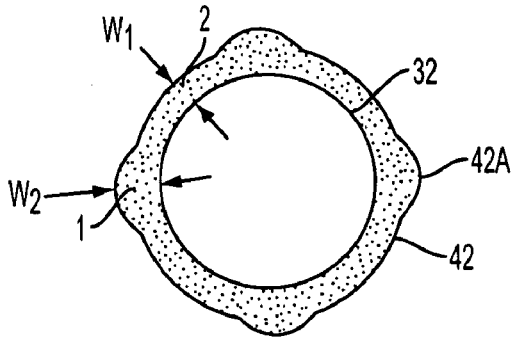

Another retaining ring in accordance with an embodiment of the present invention is schematically illustrated in FIG. 3D and has an annular inner surface 32 and an annular outer surface 42 having at least one projection 42A thereon. By varying the shapes of the inner and outer surfaces as shown, the width between the inner and outer surfaces varies in a radial direction. For example, the width $W_1$ at location 1 is smaller than the width $W_2$ at location 2.

A retaining ring in accordance with another embodiment of the present invention is schematically illustrated in FIG. 3 E and comprises annular inner surface 33 and a polygonal outer surface 43 having an optional rounded corner 43A. By varying the shapes of the inner and outer surfaces as shown, the width therebetween varies in the radial direction. For example, the width $W_1$ at location 1 is smaller than the width $W_2$ at location 2.

Figure 3E:
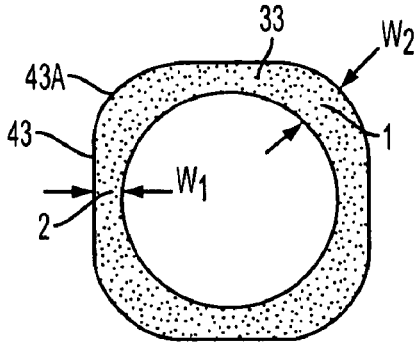
Figure 3F:
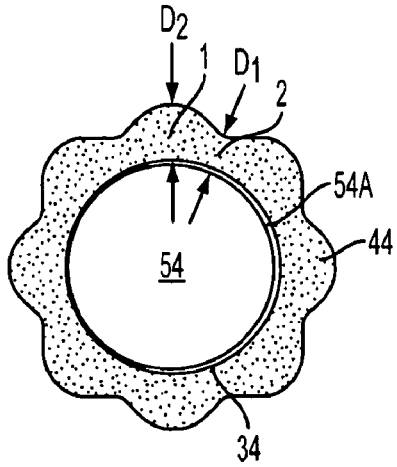

Another retaining ring in accordance with an embodiment of the present invention is schematically illustrated in FIG. 3F and comprises an annular inner surface 34 and an outer surface 44 which has a zig-zag shape, such as the illustrated wave shape with rounded projections and depressions. The inner surface 34 of the retaining ring accommodates a substrate 54 having a perimeter 54A. As illustrated, the distance between the outer surface 44 and the perimeter 54A of substrate 54 varies in a radial direction. For example, the distance $D_1$ between the perimeter 54A of the substrate 54 and outer surface 44 at location 1 is smaller than the distance $D_2$ at location 2. In this embodiment, the distance or width between the inner surface 34 and outer surface 44 would also vary at locations 1 and 2 in a similar manner, with the width at location 1 being smaller than the width at location 2.

Figure 3G:
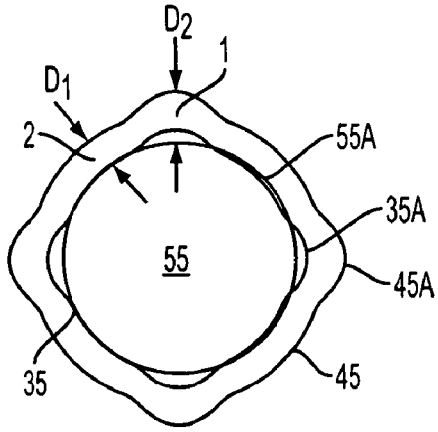

Another retaining ring in accordance with an embodiment of the present invention is schematically illustrated in FIG. 3G and comprises an inner surface 35 and an outer surface 45. Inner surface 35 contains recession 35A and the outer surface is provided with projections 45A. Inner surface 35 accommodates substrate 55 having a perimeter 55A. As illustrated, the distance between the perimeter 55A of substrate 55 and outer surface 45A at location 1 is smaller than the distance $D_2$ at location 2. In this embodiment, depending on the size of the projections 45 vis-à-vis the size of the recessions 35A, and their relative positioning, the distance between the inner and outer surfaces 35A and 45, respectively, may or may not be made to vary in the radial direction.

Figure 4A:
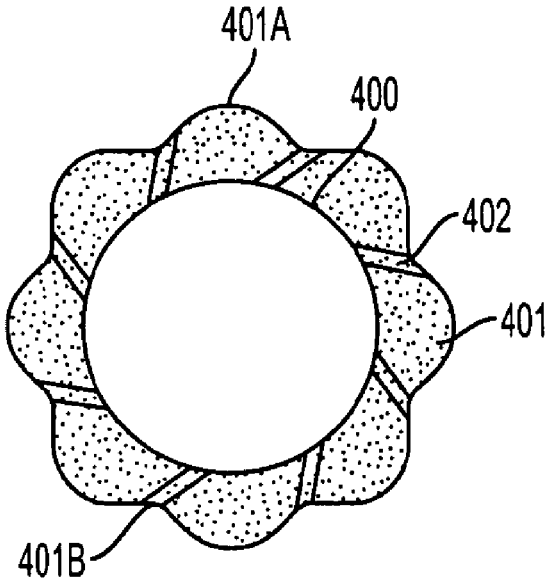
FIGS. 4A and 4B are bottom views schematically illustrating retaining rings in accordance with other embodiments of the present invention.

In various embodiments of the present invention, the retaining ring is provided with paths (grooves or channels) along the bottom surface for distribution of the polishing slurry to the substrate during CMP. For example, a retaining ring in accordance with an embodiment of the present invention is schematically illustrated in FIG. 4A and comprises an annular inner surface 400 and an annular outer surface 401 having a wave form 401A-401B. Slurry distributing paths 402 can be deployed at locations where the width from the inner surface 400 to the outer surface 401 is minimal, as at location 401B.

Figure 4B:
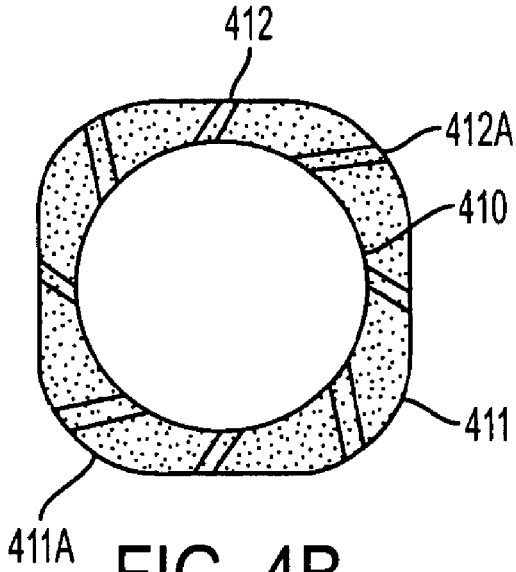

Another retaining ring in accordance with an embodiment of the present invention is schematically illustrated in FIG. 4B and comprises an annular inner surface 410 and an outer surface 411 having a polygonal shape with rounded corners similar to that illustrated in FIG. 3E. Slurry distributing paths may be provided in regions where the retaining ring has a relatively large width, such as those illustrated by reference character 412A, and in regions where the width of the retaining ring is relatively smaller, such as those identified by reference character 412. In an optional embodiment, the slurry distributing paths having various widths are deployed at locations respectively in accordance with the width from the inner surface and to outer surface. For example, the slurry distributing paths in the regions 412A have a larger width than those in the regions 412 for evenly distributing the slurry to the substrate retained by the retaining ring.

By varying the shape and/or positioning the inner and outer surfaces as disclosed herein, the edge polishing profile shifts back and forth during rotation with respect to the center of the substrate, thereby compensating or counteracting prior variations having the net effect of reducing the edge effect and achieving more uniform planarity across the entire substrate.

Figure 5A:
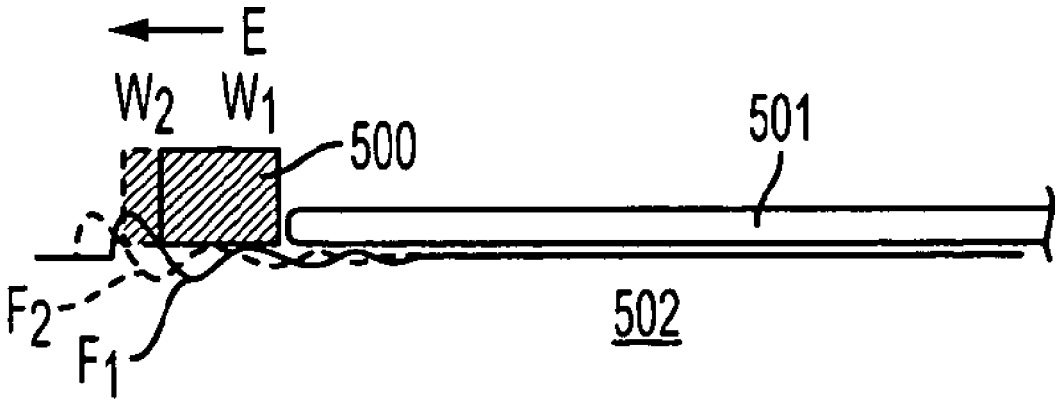
FIG. 5A schematically illustrates the effect of embodiments of the present invention by addressing a source of the edge effect problem.
Figure 5B:
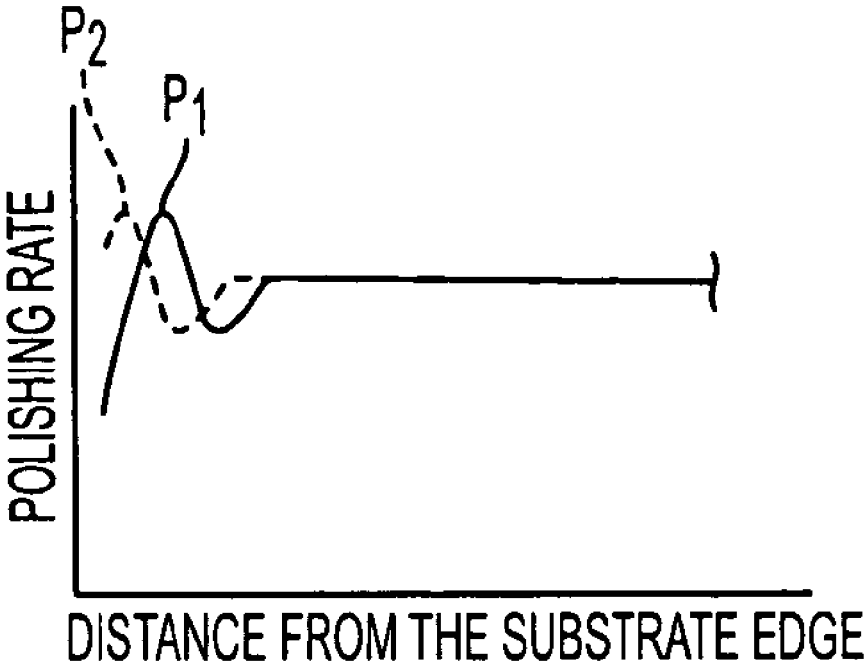
FIG. 5B is a graph illustrating the impact of embodiments of the present invention on counteracting the polishing edge effect problem.

Adverting to FIG. 5A, illustrative of the present invention, retaining ring 500 retains substrate 501 during CMP on polishing pad 502. Reference character E denotes the movement direction relative to the polishing pad 502. Retaining ring 500 is structured in accordance with an embodiment of the present invention such that the width between the inner and outer surfaces varies in the radial direction, as from width $W_1$ to width $W_2$, thereby generating two wave forms $F_1$ and $F_2$, respectively, opposite to each other. These opposite wave forms $F_1$ and $F_2$ result in two different edge polishing profiles $P_1$ and $P_2$, respectively, illustrated in FIG. 5B. These edge profiles $P_1$ and $P_2$ compensate for each other or annul each other to provide a substantially uniform edge profile across the entire surface of the substrate, including the edge.

Embodiments of present invention are not limited to retaining rings formed of a single layer, but include composite retaining rings comprising a plurality of layers. In such embodiments, the structure of the bottommost layer which contacts the polishing pad is structured as disclosed herein to reduce the edge effect.

Figure 6A:
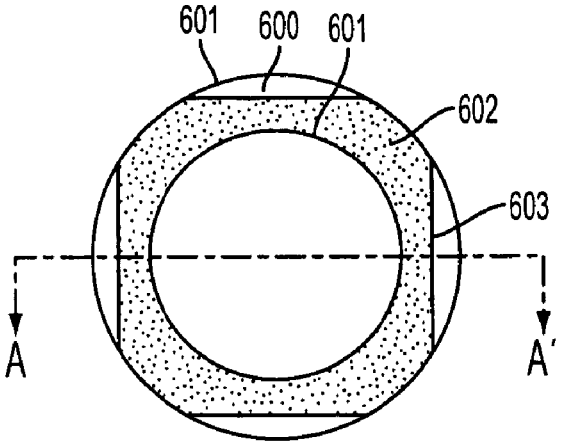
FIG. 6A is a bottom view schematically illustrating a composite retaining ring in accordance with another embodiment of the present invention.
Figure 6B:
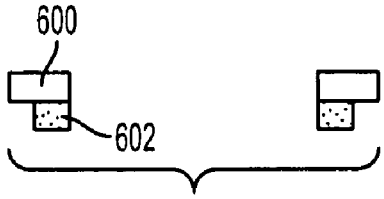
FIG. 6B is a sectional view taken along line A-A' of FIG. 6A.

A composite retaining ring in accordance with an embodiment of the present invention is schematically illustrated in FIGS. 6A and 6B. The illustrated retaining ring comprises a two-piece composite structure with a top layer 600 having an outer annular surface 601 and a lower or bottom layer 600 having an outer surface 603 similar to that illustrated in FIG. 3E, i.e., a polygonal shape with rounded corners, such that the width between the inner and outer surfaces of the bottom layer varies in a radial direction. The lower portion or bottom layer 602 may be formed of a material which is chemically inert during CMP and exhibits sufficient elasticity such that contact with the substrate edge does not cause chipping or cracking of the substrate. Suitable materials for the lower portion, which exhibits a lower hardness than the top layer 600, include various plastics, such as polyphenylene sulfide (PPS), polyethylene terephthalate (PET), polyetheretherketone (PEEK) and polybutylene terephthalate (PBT), or various commercially available composite materials. The upper portion 600 may be made of a rigid material, such as a metal, e.g., stainless, molybdenum, or aluminum or a ceramic, such as alumina. Typically, the thickness of the lower layer 602 should be larger than the thickness of the substrate retained therein. In forming composite retaining rings in accordance with embodiments of the present invention, the various layers can be bonded together in any manner, as by employing an adhesive or mechanical means.

The composite retaining ring illustrated in FIG. 6A has a cross sectional shape as illustrated in FIG. 6B. It should be understood that top and bottom layers can be designed to obtain a stepwise profile as in FIG. 6B, or a gradual profile across the entire thickness. Embodiments of the present invention are not limited to any particular cross sectional shape or number of layers. Embodiments of the present invention also include retaining rings formed of a single layer having a stepwise cross sectional shape or a gradual profile.

Embodiments of the present invention include retaining rings for retaining a substrate in a polishing head of a CMP apparatus and enabling uniform planarization of substrates without encountering an adverse edge profile effect or by substantially reducing the edge effect to obtain substrates suitable for forming reliable devices thereon. Embodiments of the present invention can be utilized in all types of CMP apparatus for retaining all types of substrates undergoing all types of CMP. Embodiments of the present invention enjoy utility in conducting CMP on various types of layers during fabrication of integrated circuits, such as metal layers, polycrystalline silicon layers, insulating or dielectric layers in combinations thereof. Embodiments of the present invention, therefore, enjoy industrial applicability during CMP in fabricating various types of semiconductor chips, including chips having highly integrated semiconductor devices, including memory semiconductor devices, with high dimensional accuracy.

In the preceding description, the present invention is described with reference to specifically exemplary embodiments thereof. It will, however, be evident that various modifications and changes may be made thereto without departing from the broader spirit and scope of the present invention, as set forth in the claims. The specification and drawings are, accordingly, to be regarded as illustrative and not as restrictive. It is understood that the present invention is capable of using various other combinations and embodiments and is capable of any changes or modifications within the scope of the inventive concept as expressed herein.

What is claimed is:

1. A method of planarizing a substrate by chemical mechanical polishing (CMP), the method comprising planarizing the substrate while retained in a polishing head including a retaining ring, the retaining ring having an outer surface and an inner surface such that a width from the inner surface to the outer surface in a radial direction varies in an amount sufficient to substantially reduce an edge effect by causing an edge polishing profile to shift back and forth toward a center of the substrate as the width varies during chemical mechanical polishing, wherein:

the outer surface has an annular shape with a feature selected from the group consisting of at least one projection, at least one recession, and a combination thereof;

the width varies from about 2% to about 50% with respect to an average width;

the inner surface has an annular shape with at least one recession;

the outer surface has an annular shape with at least one projection; and the at least one recession on the inner surface is radially aligned with the at least one projection on the outer surface.

2. A method of planarizing a substrate by chemical mechanical polishing (CMP), the method comprising planarizing the substrate while retained in a polishing head including a retaining ring, the retaining ring having an outer surface and an inner surface such that a width from the inner surface to the outer surface in a radial direction varies in an amount sufficient to substantially reduce an edge effect by causing an edge polishing profile to shift back and forth toward a center of the substrate as the width varies during chemical mechanical polishing, wherein the outer surface has a polygonal shape.

3. The method according to claim 2, wherein the polygonal shape has rounded corners.

4. A method of planarizing a substrate by chemical mechanical polishing (CMP), the method comprising planarizing the substrate while retained in a polishing head including a retaining ring, the retaining ring having an outer surface and an inner surface such that a width from the inner surface to the outer surface in a radial direction varies in an amount sufficient to substantially reduce an edge effect by causing an edge polishing profile to shift back and forth toward a center of the substrate as the width varies during (CMP) chemical mechanical polishing, wherein the outer surface has a zig-zag shape.

5. The method according to claim 4, wherein the outer surface has a wave shape with rounded corners.

6. A method of planarizing a substrate by chemical mechanical polishing (CMP), the method comprising planarizing the substrate while retained in a polishing head including a retaining ring, the retaining ring having an outer surface and an inner surface such that a width from the inner surface to the outer surface in a radial direction varies in an amount sufficient to substantially reduce an edge effect by causing an edge polishing profile to shift back and forth toward a center of the substrate as the width varies during chemical mechanical polishing, wherein the outer surface has an elliptical shape.

7. A method of planarizing a substrate by chemical mechanical polishing (CMP), the method comprising planarizing the substrate while retained in a polishing head including a retaining ring to control edge effect of the substrate during chemical mechanical polishing, the retaining ring comprising:

an upper surface;

a lower surface;

an outer surface; and an inner surface, wherein:

a width from the inner surface to the outer surface in a radial direction varies along a circumference of the retaining ring;

the width at any point is constant across the entire thickness between the upper and lower surfaces of the retaining ring; and the inner surface has an annular shape and the outer surface has a non-annular shape.

8. A method of planarizing a substrate by chemical mechanical polishing (CMP), the method comprising planarizing the substrate while retained in a polishing head including a retaining ring to control edge effect of the substrate during chemical mechanical polishing, the retaining ring comprising:

an inner surface; and an outer surface, wherein the outer surface has an elliptical shape.

9. A method of planarizing a substrate by chemical mechanical polishing (CMP), the method comprising planarizing the substrate while retained in a polishing head including a retaining ring to control edge effect of the substrate during chemical mechanical polishing, the retaining ring comprising:

an inner surface; and an outer surface, wherein the outer surface has a polygonal shape.

10. The method according to claim 9, wherein the polygonal shape has rounded corners.

11. A method of planarizing a substrate by chemical mechanical polishing (CMP), the method comprising planarizing the substrate while retained in a polishing head including a retaining ring to control edge effect of the substrate during chemical mechanical polishing, the retaining ring comprising:

an inner surface; and an outer surface, wherein the outer surface has a zig-zag shape.

12. The method according to claim 11, wherein the outer surface has a wave shape with rounded corners.

13. A method of planarizing a substrate by chemical mechanical polishing, the method comprising planarizing the substrate while retained in a polishing head including a retaining ring, the retaining ring comprising:

an upper surface;

a lower surface;

an outer surface; and an inner surface, wherein:

a width from the inner surface to the outer surface in a radial direction varies along a circumference of the retaining ring; and the width at any point is constant across the entire thickness between the upper and lower surfaces of the retaining ring, the retaining ring further comprising slurry distributing paths, wherein the slurry distributing paths are deployed at locations where the width from the inner surface to the outer surface is minimal.

14. A method of planarizing a substrate by chemical mechanical polishing, the method comprising planarizing the substrate while retained in a polishing head including a retaining ring, the retaining ring comprising:

an upper surface;

a lower surface;

an outer surface; and an inner surface, wherein:

a width from the inner surface to the outer surface in a radial direction varies along a circumference of the retaining ring; and the width at any point is constant across the entire thickness between the upper and lower surfaces of the retaining ring, the retaining ring further comprising slurry distributing paths, wherein the slurry distributing paths having various widths are deployed at locations respectively in accordance with the width from the inner surface to the outer surface.

15. The method according to claim 2, wherein the inner surface has an annular shape.

16. The method according to claim 4, wherein the inner surface has an annular shape.

17. The method according to claim 6, wherein the inner surface has an annular shape.

18. The method according to claim 8, wherein:

the inner surface has an annular shape; and a width from the inner surface to the outer surface varies in a radial direction.

19. The method according to claim 9, wherein:

the inner surface has an annular shape; and a width from the inner surface to the outer surface varies in a radial direction.

20. The method according to claim 11, wherein:

the inner surface has an annular shape; and a width from the inner surface to the outer surface varies in a radial direction.

* * * * *